US005839519A

United States Patent [19]

Spedale, Jr.

[11] Patent Number: 5,839,519

[45] Date of Patent: Nov. 24, 1998

[54] METHODS AND APPARATUS FOR ATTACHING A CASING TO A DRILL BIT IN OVERBURDEN DRILLING EQUIPMENT

[75] Inventor: Angelo Lee Spedale, Jr., Cypress, Tex.

[73] Assignee: Sandvik AB, Sandviken, Sweden

[21] Appl. No.: 746,268

[22] Filed: Nov. 8, 1996

[51] Int. Cl.[6] ..... E21B 4/14

[52] U.S. Cl. ..... 175/57; 175/296

[58] Field of Search ..... 175/57, 107, 92, 175/293, 296; 173/52, 73

[56] References Cited

U.S. PATENT DOCUMENTS

| | | | |
|---|---|---|---|
| 3,190,378 | 6/1965 | Davey, Sr. et al. . | |
| 3,682,260 | 8/1972 | Klemm | 175/92 |
| 3,768,576 | 10/1973 | Martini | 173/73 |
| 4,819,746 | 4/1989 | Brown et al. | 175/296 |
| 5,009,274 | 4/1991 | Löf | 175/260 |
| 5,040,621 | 8/1991 | Löf | 175/258 |
| 5,255,960 | 10/1993 | Ilomäki . | |
| 5,542,483 | 8/1996 | Edman | 175/257 |

*Primary Examiner*—Frank Tsay
*Attorney, Agent, or Firm*—Burns, Doane, Swecker & Mathis, L.L.P.

[57] ABSTRACT

An overburden drilling device includes a drill bit body, a percussion element for applying impacts to the body, and a casing attached to the body. The casing is connected to the drill bit body by a casing shoe which comprises semi-cylindrical halves which are held together by a circular ring that is welded to the halves. The casing shoe and the drill bit body are interconnected by radially overlapping walls so that the drill bit body pulls the casing along during a drilling operation.

14 Claims, 5 Drawing Sheets

METHODS AND APPARATUS FOR ATTACHING A CASING TO A DRILL BIT IN OVERBURDEN DRILLING EQUIPMENT

TECHNICAL BACKGROUND

The present invention relates to overburden drilling equipment and a casing shoe, wherein the overburden drilling equipment comprises a drill bit body having a connection section at a rear end for connection to a percussive unit such as a down-the-hole hammer and defining a rotational axis of a drill bit, and a casing shoe for attachment to a casing, the casing shoe connected to the drill bit body by mutual engagement of a groove and a collar in a lap-joint.

PRIOR ART

Overburden drilling equipment is previously disclosed in U.S. Pat. No. 5,255,960, for example. It has been found favorable to construct overburden drilling equipment such that the casing and the rock drill bit are relatively rotatable while simultaneously axially connected, so that the drill bit pulls the casing along as the drill bit advances in the ground. The solution to such relative rotation is described in the above-named patent as a "lap-joint", wherein the casing, or a casing shoe attached to the front of casing, axially overlaps the drill bit. A split collar welded to the inside of the casing projects into a circumferential groove formed in the drill bit enabling the drill bit to pull the casing along. It has now been found that the weld often breaks, such that the axial advance of the casing is stopped. Furthermore, there has been only limited access space within the casing for applying the weld.

An object of the present invention is to provide an overburden drilling equipment, a casing collar per se, and a method of attaching a casing collar, which obviate the above-mentioned drawbacks.

SUMMARY OF THE INVENTION

That and other objects of the present invention have been attained by an overburden drilling equipment comprising a drill bit body, and a casing shoe. The drill bit body which defines a longitudinal axis of rotation, includes a cutting face at a longitudinal front end of the body, and a connection section at a longitudinal rear end of the body adapted for connection with a percussive unit. The casing shoe is generally cylindrical and is adapted for attachment to a casing. The drill bit body includes a radially outwardly extending, longitudinally forwardly facing first wall. The casing shoe includes a radially inwardly extending, longitudinally rearwardly facing second wall facing the first wall to be engaged and longitudinally advanced thereby during a drilling operation. The casing shoe comprises two substantially identical semi-cylindrical halves, and an endless substantially circular ring extending coaxially around the halves to hold the halves together.

Preferably, the ring is welded to the halves by front and rear welds disposed at front and rear sides, respectively of the ring.

The ring is preferably formed in circumferential recesses formed in front ends of the respective halves, the recesses being circumferentially aligned with one another.

The invention also pertains the casing shoe per se, and to a method of mounting the casing shoe on a drill bit body.

DESCRIPTION OF THE DRAWINGS

The objects and advantages of the invention will become apparent from the following detailed description of preferred embodiments thereof in connection with the accompanying drawings, and in which.

DETAILED DESCRIPTION OF PREFERRED EMBODIMENTS OF THE INVENTION

Figure 1A:
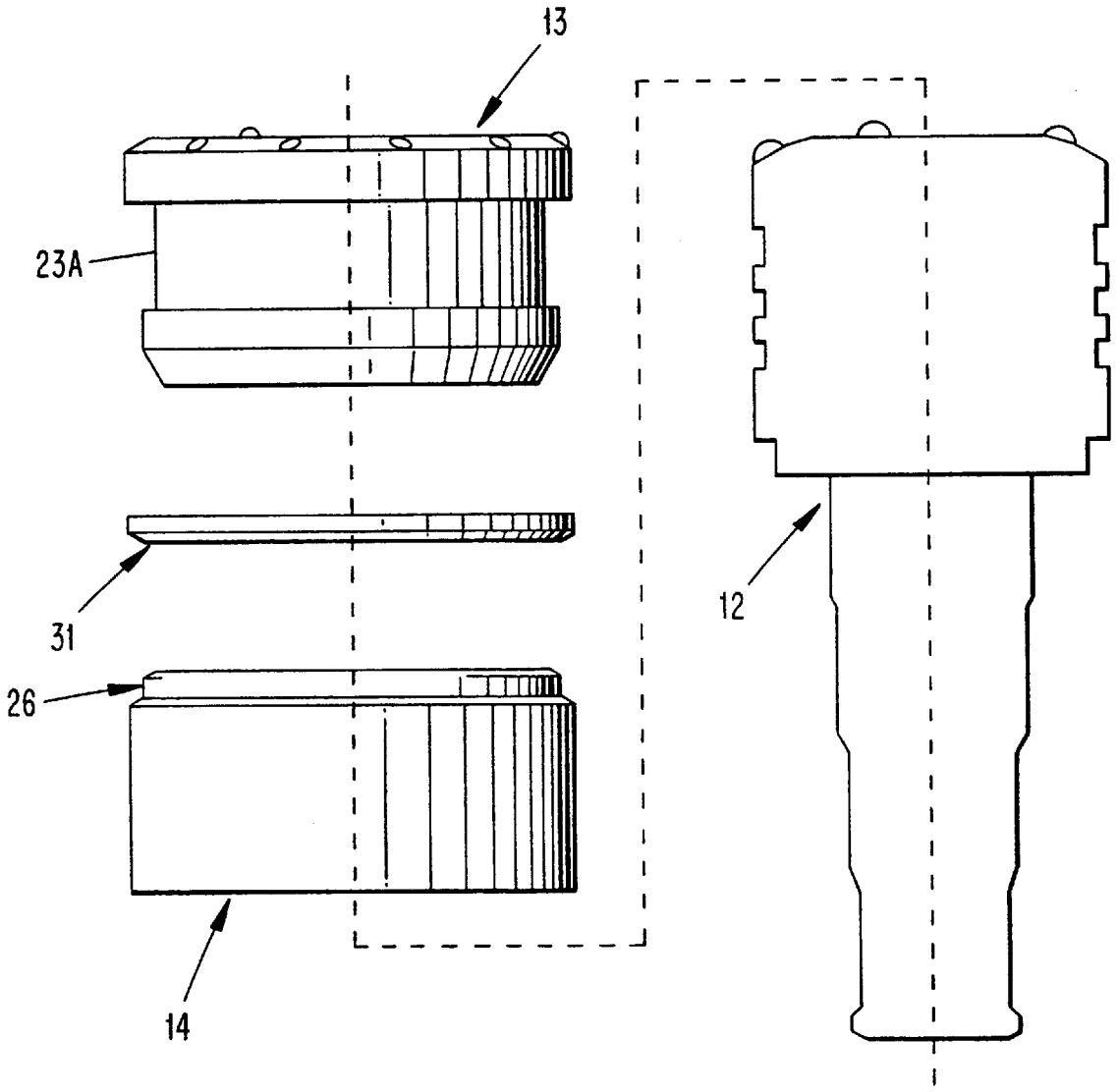
FIG. 1A shows an exploded view of an overburden drilling equipment according to the present invention.
Figure 1B:
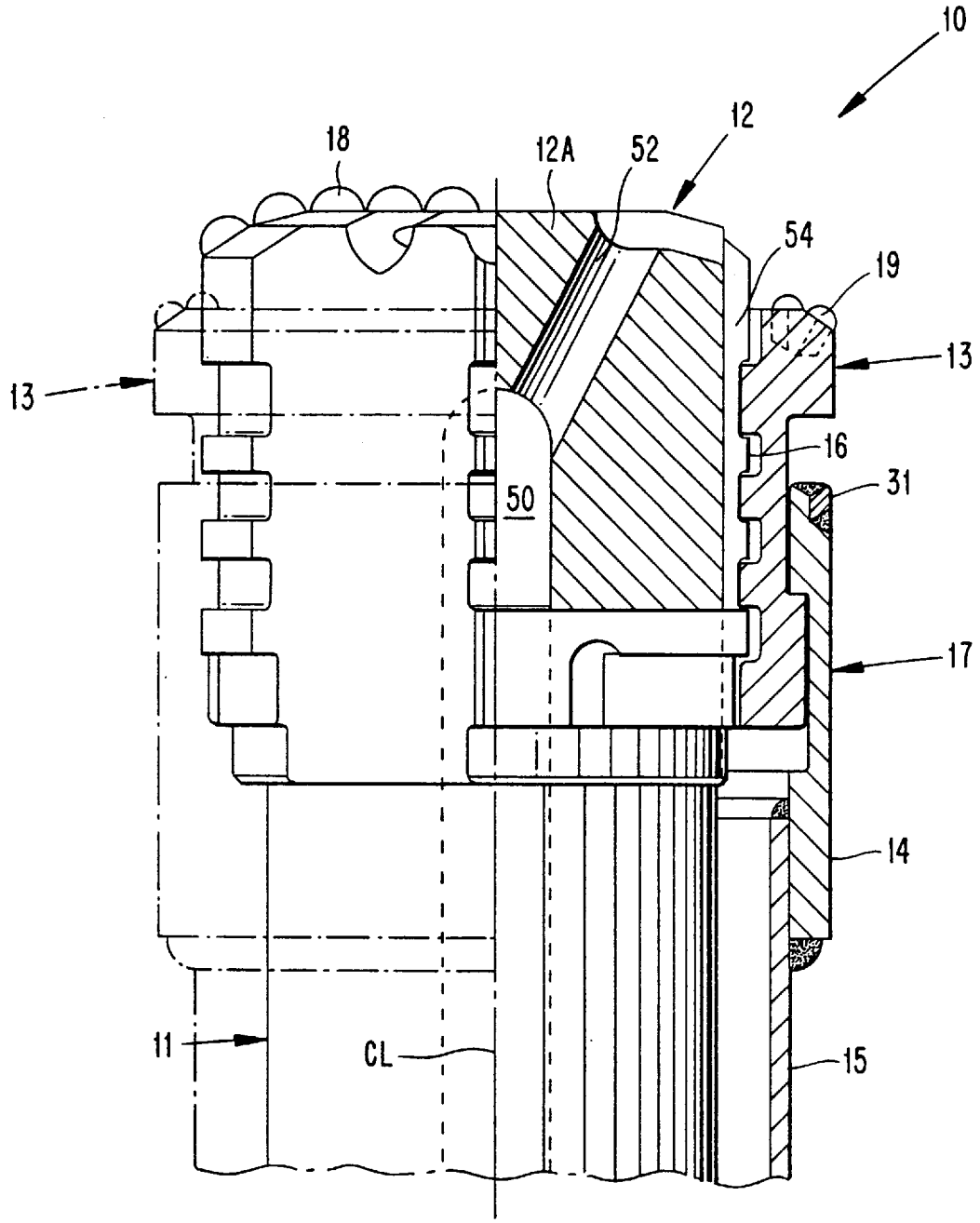
FIG. 1B shows a left half of the equipment in side view, and a right half of the overburden drilling equipment in longitudinal section.
Figure 1C:
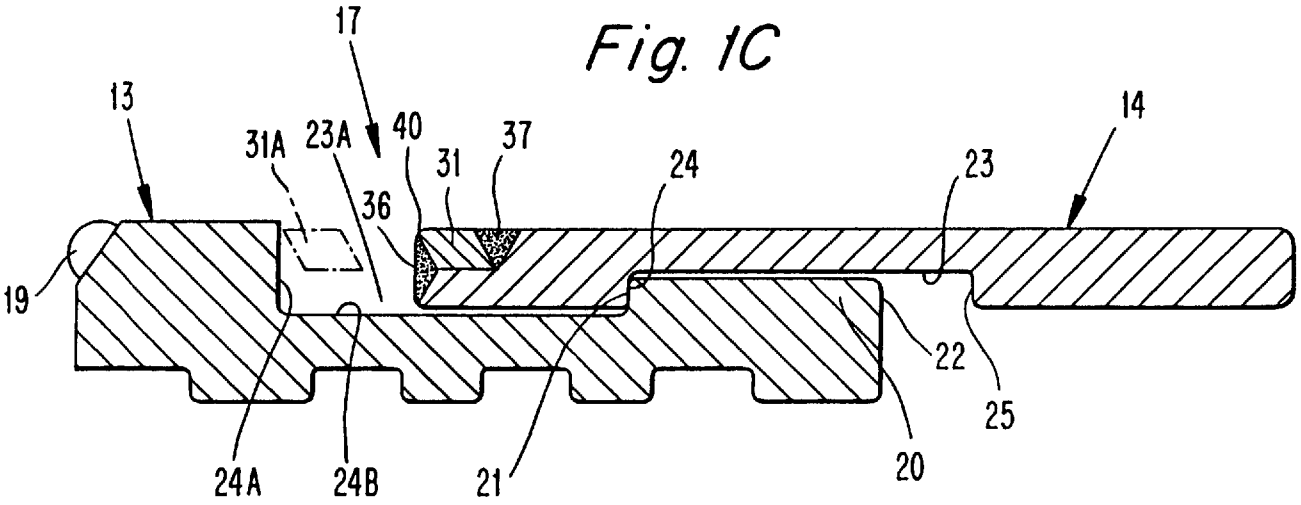
FIG. 1C shows an enlargement of a joint between a ring bit and a casing shoe of the overburden drilling equipment shown in FIG. 1B.

In FIGS. 1A–C there is shown a preferred embodiment of overburden drilling equipment according to the present invention. The equipment 10 comprises a down-the-hole hammer 11, a pilot drill bit 12, a ring drill bit 13, a casing shoe 14 and a casing 15. The pilot drill bit 12 and the ring drill bit 13 together define a drill bit body.

The hammer 11 is preferably of the pneumatic type and produces axial impacts against the pilot drill bit 12. The pilot drill bit is provided with cemented carbide inserts 18 and is connected to the ring bit 13 via threads, splines or protrusions 16. The ring bit is provided with cemented carbide inserts 19 and is connected to the casing shoe 14 in a manner allowing relative rotational movement between the ring bit 13 and the casing shoe 14 about the rotational axis CL. The casing shoe is rigidly connected to the casing 15, preferably by means of a weld.

As thusfar described, the equipment is similar to prior art, and the general idea of this kind of equipment is to drill a hole with the equipment and to leave the ring bit, casing shoe and the casing in the hole by uncoupling the pilot bit from the ring bit before retracting the hammer and the pilot bit therefrom. It would be possible to retract the entire equipment if the ground around the casing is of such a nature as to remain stable after retraction of the equipment.

Turning now to FIG. 1C, the joint 17 of FIG. 1B is shown in an enlarged cross-sectional view. The ring bit 13 includes at an axial inner end thereof a circumferentially extending external collar 20 comprising axially spaced walls 21 and 22, facing longitudinally forwardly and rearwardly, respectively, and extending substantially perpendicular to the rotational axis CL. The wall 21 cooperates with a longitudinally rearwardly facing wall 24A to form in the ring bit a circumferential groove 23A having a floor 24B. A circumferentially extending internal groove 23 is provided in the casing shoe 14 for receiving the collar 10. The groove 23 is bordered by axially spaced walls 24 and 25 facing longitudinally rearwardly and forwardly, respectively, and extending substantially perpendicular to the axis CL. The axial length of the groove is larger than the axial length of the collar, so as to allow some axial movement of the casing relative to the ring bit. These lengths are chosen, however, such that the free or outer end 40 of the casing shoe never impacts on the ring bit.

Figure 2A:
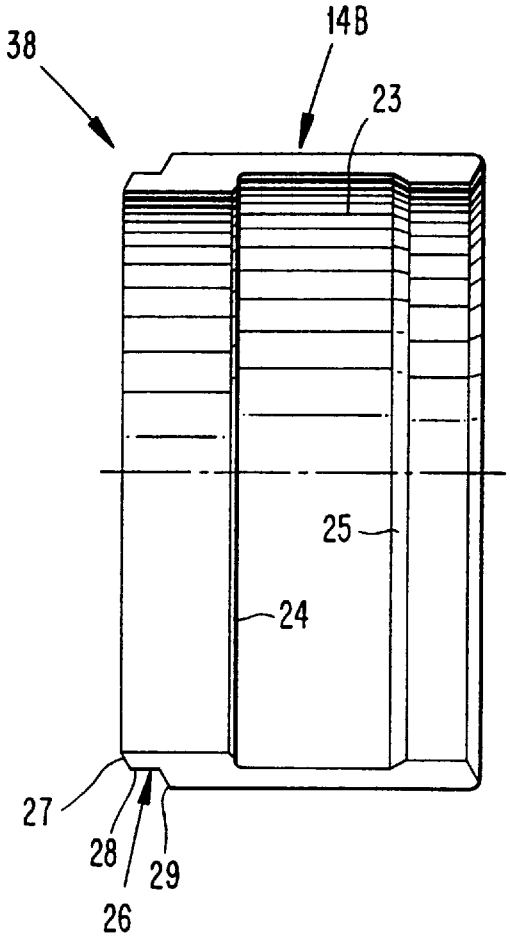
FIG. 2A shows a side view of one half of a casing shoe.
Figure 2B:
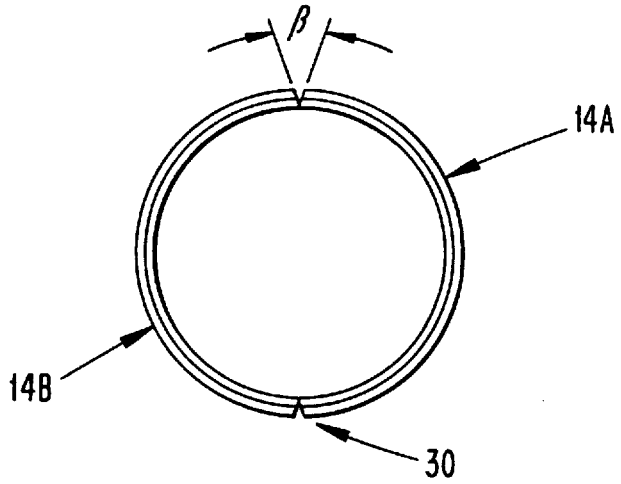
FIG. 2B shows an assembled two-piece casing shoe in a front view.

The casing shoe 14 comprises two substantially identical, mirror-imaged halves 14A and 14B of generally semi-cylindrical shape (see FIGS. 2A and 2B). In the front portion 38 of each half there is provided a circumferential recess 26 comprising a first or front bevel 27, a land 28 and a second or rear bevel 29. The land 28 is substantially parallel with the rotational axis CL and connects to the first bevel 27 over an external corner defining an obtuse angle. The land 28 connects to the second bevel 29 over an internal corner defining an obtuse angle. The first bevel 27 and the second bevel 29 are substantially parallel. Longitudinal edges 30 of the halves are prepared for welding by being shaped as longitudinally extending bevels which together form an angle β for receiving a weld.

Figure 3:
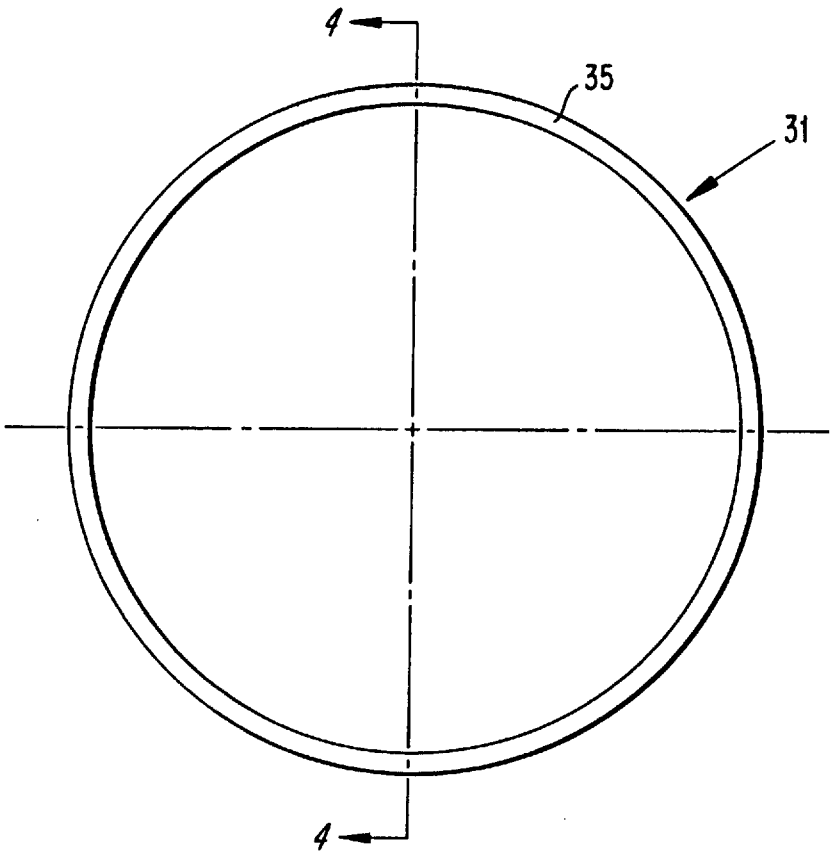
FIG. 3 shows a one-piece ring in plan view.
Figure 4:
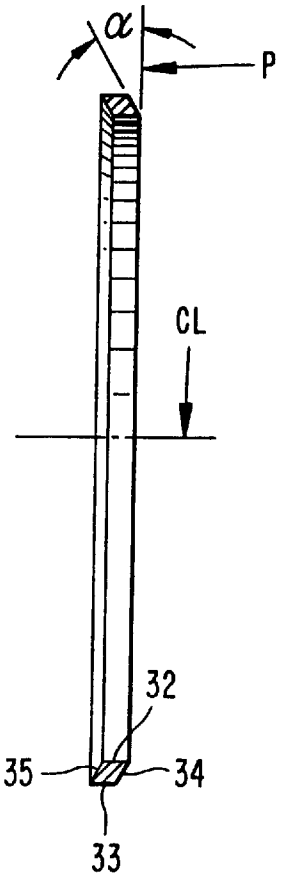
FIG. 4 shows a section of the one piece ring taken along line 4—4 in FIG. 3.

A ring 31 is provided to position the two halves in preparation for the welding (see FIGS. 3 and 4). The ring 31 has a substantially rhomboidal cross-section and comprises parallel, planar, radially spaced internal and external surfaces 32, 33 and two axially spaced surfaces 34 and 35 each extending obliquely relative to the rotational axis CL. Each of the inclined surfaces 34 and 35 forms an acute angle α with a line P extending perpendicular to the rotational axis CL. The angle α is preferably about 30°.

The casing shoe 14 is mounted to the ring bit 13 in the following way. The smallest diameter of the ring 31 is larger than the largest diameter of the collar 20 of the ring bit 13. This means that the ring can be positioned around a floor 23A of the groove 23 of the ring bit, as illustrated at 31A by dotted lines in FIG. 1C. After this has been done, the halves 14A and 14B of the casing shoe 14 are placed around the ring bit such that the groove 23 of the casing shoe receives the collar 20 of the ring bit. While halves are held around the ring bit, the ring 31 is slipped axially over the circumferentially aligned recess 26 such that the halves become positioned relative to each other and relative to the ring bit. Then, front and rear V-shaped recesses formed by the inclined surfaces 34, 35 of the ring and the first and second bevels 27 and 29, respectively, of the casing shoe, are adapted for welding. Welding is performed by first filling the formed recesses with welding material, thereby creasing an axially forward weld 36 and an axially rearward weld 37. Then, the longitudinally extending joints formed by the bevels 30 are welded together. Alternatively, the longitudinally extending bevels 30 may be welded first.

Now a casing shoe for an overburden drilling equipment can be produced with a durable weld, such that the axial advancing of the casing can be maintained during a substantial period of time. Furthermore, there has been developed a large access space for applying the weld, which makes the equipment easier to produce.

Figure 5:
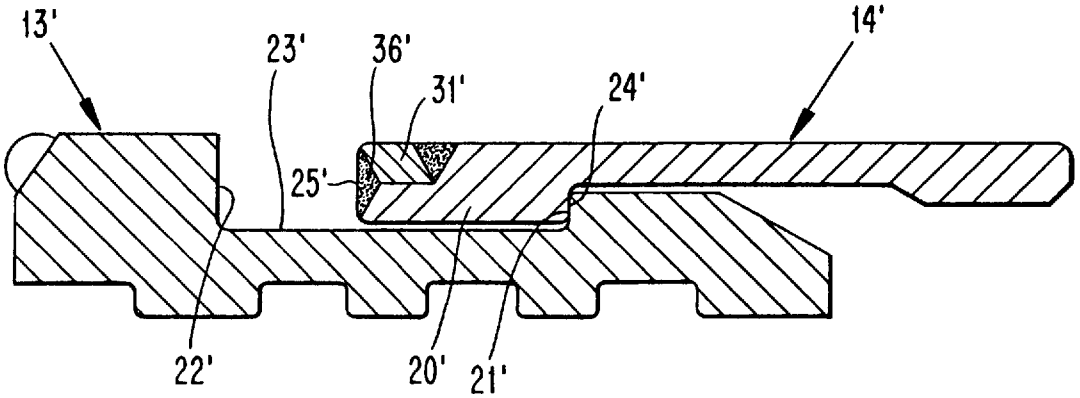
FIG. 5 shows a joint between a ring bit and a casing shoe of an,alternative overburden drilling equipment according to the present invention in a view similar to FIG. 1C.

Turning now to FIG. 5 an alternative embodiment of overburden drilling equipment according to the present invention is shown in a view similar to FIG. 1B. The periphery of the ring bit 13' is provided with a circumferentially extending internal groove 23' comprising axially spaced walls 21' and 22' extending substantially perpendicular to the rotational axis CL. A corresponding circumferentially extending external collar 20' is provided on the casing shoe 14'. The collar 20' is bordered by axially spaced walls 24' and 25'. The axial length of the groove 23' is larger than the axial length of the collar 20', so as to allow some axial movement of the casing relative to the ring bit. The axial lengths are chosen, however, such that the axially forward weld 36' of the casing shoe is allowed to impact on the ring bit. The weld 36' that forms the impacting surface 25' can be formed of a material which is durable under such impacts.

In operation of the overburden equipment, the drill bit body is rotated while being impacted by the percussion device, to drill a hole. As the bit body advances, the wall 24 of the ring bit engages the wall 21 of the casing shoe to pull the casing along. Fluid is conducted through internal passages 50, 52 to the front of the bit body to cool and clean the inserts 18. That fluid, along with cuttings entrained therein, exits the hole through a return channel 54 disposed radially internally of the casing shoe, and then travels within the casing 15.

The invention can be varied freely within the scope of the appended claims. Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed:

1. Overburden drilling apparatus for drilling a hole, comprising:

a drill bit body defining a longitudinal axis of rotation and including a cutting face at a longitudinal front end of the body, and a connection section at a longitudinal rear end thereof adapted for connection with a percussive unit; and a generally cylindrical casing shoe adapted for attachment with a casing;

the drill bit body including a radially outwardly extending longitudinally forwardly facing first wall, said casing shoe including a radially inwardly extending longitudinally rearwardly facing second wall facing the first wall to be engaged and longitudinally advanced thereby during a drilling operation;

the casing shoe comprising two substantially identical semi-cylindrical halves, and an endless substantially circular ring extending coaxially around the halves to hold the halve together.

2. The apparatus according to claim 1, further including a percussion unit connected to the connection section, and a casing attached to a rear end of the casing shoe and encircling the percussion unit.

3. The apparatus according to claim 1 wherein the ring is welded to the halves by front and rear welds disposed at front and rear sides, respectively, of the ring.

4. The apparatus according to claim 3 wherein the ring is disposed in circumferential recesses formed in front ends of the respective halves.

5. The apparatus according to claim 4 wherein each of the recesses includes longitudinally spaced front and rear bevels, the front bevel situated radially inwardly with respect to the rear bevel, the ring including longitudinally spaced external and internal surfaces being generally parallel to one another and inclined obliquely with respect to the axis of rotation so that the external surface and the front bevel together form a front V-shaped recess and the internal surface and the rear bevel together form a rear V-shaped recess, the front and rear welds being disposed in the front and rear V-shaped recesses, respectively.

6. The apparatus according to claim 1 wherein the second wall is of integral one-piece construction with the casing shoe.

7. The apparatus according to claim 6 wherein the first wall constitutes a rear wall of a circumferential first groove formed in the body.

8. The apparatus according to claim 7 wherein the second wall constitutes a front wall of a circumferential second groove formed in the casing shoe.

9. The apparatus according to claim 1 wherein the drill bit body comprises a pilot drill bit and a ring bit mounted on an outer periphery of the pilot drill bit, the first wall being of integral one-piece construction with the ring bit.

10. A casing shoe adapted to connected a cylindrical casing to a drill bit body, comprising:

two substantially identical semi-cylindrical halves adapted to be brought together to form a cylinder defining a longitudinal axis, each half including a circumferential recess at its front end, and a longitudinally rearwardly facing wall extending radially inwardly at a location disposed longitudinally forwardly of a rear end of the respective half, the recesses becoming circumferentially aligned with one another when the halves are brought together; and an endless, substantially circular ring sized to longitudinally enter the aligned recesses for holding the halves together, and to be welded to the halves.

11. The casing shoe according to claim 10 wherein each recess includes longitudinally spaced front and rear bevels, the front bevel situated radially inwardly with respect to the rear bevel, the ring including longitudinally spaced external and internal surfaces being generally parallel and inclined obliquely with respect to the axis so that the external surface and the front bevel together form a front V-shaped recess, and the internal surface and the rear bevel together form a rear V-shaped recess, the front and rear V-shaped recesses adapted to receive separate weld.

12. A method of mounting a casing shoe on a drill bit body, comprising the steps of:

a. inserting an endless circular ring within a circumferential groove formed in an outer periphery of the drill bit body, the groove including a longitudinally forwardly facing first wall;

b. installing around the drill bit body a casing shoe comprised of two substantially identical semi-cylindrical halves by bringing the halves together such that a longitudinally rearwardly facing second wall of the casing shoe faces the first wall;

c. displacing the ring longitudinally rearwardly until the ring surrounds front portions of the halves;

d. welding the ring to the halves; and e. welding the halves together along longitudinal joints thereof.

13. The method according to claim 12 wherein step c includes inserting the ring into circumferential recesses formed in the front portions of the halves.

14. The method according to claim 13 wherein step d includes forming axial front and rear welds within the recesses along opposite axial sides of the ring.

* * * * *